United States Patent [19]

Farino

[11] 3,957,057

[45] May 18, 1976

[54] BRASSIERE

[75] Inventor: Frank G. Farino, Shaker Heights, Ohio

[73] Assignee: Leading Lady Foundations, Inc., Cleveland, Ohio

[22] Filed: Sept. 8, 1975

[21] Appl. No.: 606,857

[52] U.S. Cl. ..... 128/478; 128/485; 128/498; 128/500

[51] Int. Cl.[2] ..... A41C 3/10

[58] Field of Search ..... 128/461, 462, 478, 479, 128/480, 483, 485, 494, 498, 500; 3/36

[56] References Cited

UNITED STATES PATENTS

| | | | |
|---|---|---|---|
| 3,247,853 | 4/1966 | Sloate | 128/479 |
| 3,384,091 | 5/1968 | Block | 128/478 |
| 3,568,681 | 3/1971 | Comollo | 128/478 |

*Primary Examiner*—Werner H. Schroeder
*Assistant Examiner*—Moshe I. Cohen
*Attorney, Agent, or Firm*—Meyer, Tilberry & Body

[57] ABSTRACT

There is provided an improved mastectomy brassiere of the type including two breast cups each adapted to receive either a natural breast or a mastectomy form pad. Each of the breast cups has two upwardly tapering, non-elastic margin strips, a lower curved margin strip connecting said tapering margin strips, an outer non-elastic fabric cover with a desired breast forming contour and a retaining means generally spaced from the fabric cover to form a pocket for a mastectomy form pad. The improvement comprises providing the retaining means as first and second separate stretchable flaps with the first flap secured along one of the marginal strips and along the lower strip, the second flap secured along the other of the margin strips and along the lower strip and wherein the flaps are overlapped at the lower strip to define an upper, generally triangular access opening for the mastectomy form pad.

11 Claims, 5 Drawing Figures

BRASSIERE

The present invention relates to the art of brassieres and more particularly to an improved mastectomy brassiere.

The invention is particularly applicable for use by a mastectomy patient having a single breast surgically removed and it will be described with particular reference thereto. It is appreciated that the invention has broader applications and may be used for a mastectomy patient having a double mastectomy operation.

BACKGROUND OF INVENTION

In recent years, extensive effort has been directed toward improving the postoperative comfort of a mastectomy patient. In furtherance of this effort, substantial improvements are being made in mastectomy brassieres so that the mastectomy patient has a somewhat normal appearing bust line. This is essential for preventing, to the extent possible, some of the emotional strain surrounding this type of surgical procedure. It has now become somewhat common practice to use a mastectomy form pad, which is a unit having, as close as possible, the contour and physical reaction of a natural breast. The mastectomy form pad is inserted into the side of a brassiere corresponding to the mastectomy operation while a normal breast occupies the other breast cup of the brassiere.

At first, especially designed mastectomy brassieres were not available. Thus, a mastectomy patient was required to shop for a standard brassiere and then have a retaining structure sewed into one breast cup for reception of the form pad. This presented substantial inconvenience and embarrassment to a mastectomy patient. She must shop for a standard brassiere and then request the store to construct a pocket or pad receptacle. Not all stores were staffed for this purpose. In addition, the modification procedure was expensive and was often done by unskilled persons in a manner to cause discomfort to the wearer and an unnatural appearance to an observer. In addition, the patient often had to return for the brassiere or wait an extensive time for the alteration, even if a store were staffed for this purpose. To overcome these inconveniences, unsatisfactory results, and expense, in recent years special mastectomy brassieres have been designed. These brassieres generally include a somewhat nomal front cover for each of the breast cups. Behind the front cover some type of retaining means is attached to hold a mastectomy form pad. These prior mastectomy brassieres often included a pocket for inserting the pad from one side. Indeed, generally the pad had to be inserted into the pocket in a certain orientation. Since mastectomy operations are not always uniform, the prior mastectomy brassieres which held the pad in a fixed position were not always satisfactory to produce the proper outward appearance. In addition, often the pocket was formed from a non-stretch material which would be visible on the brassiere side receiving the natural breast. It distorted the natural breast and prevented uniform appearance between the natural and artificial breast.

To overcome some of these disadvantages of prior mastectomy brassieres including non-stretch material for forming the pad pocket, a stretch pocket was formed for insertion of the breast pad from the side. It was found that this insertion procedure was quite difficult and often distorted the pad to destroy its natural appearance. In addition, when the pocket was formed from stretch material having an opening at the side for inserting the pad, the pocket for the pad often entrapped air and distorted the appearance of the natural breast.

All of these difficulties in producing a brassiere for a mastectomy patient have been complicated by the fact that brassiere manufacturers generally do not have access to a model, since mastectomy patients are somewhat reticent about their condition. Thus, the various efforts to make a mastectomy brassiere have involved attempts to solve the appearance and comfort problems and then testing the sales acceptance. This procedure has made it quite apparent that prior attempts to make mastectomy brassieres which are comfortable to wear and provide a normal appearance have been unsatisfactory.

THE PRESENT INVENTION

The present invention relates to an improved mastectomy brassiere which overcomes the problems experienced in prior attempts to produce such a mastectomy brassiere. In accordance with the present invention, the retaining means for the form pad is formed from two separate stretchable flaps which overlap each other behind the normal brassiere front cover or shield to produce a generally triangular upper opening for insertion of the form pad into the proper brassiere cup. By forming these flaps so that they extend upwardly a substantial distance along the tapered portion of a standard breast cup, the form pad is suspended within the pocket formed from a somewhat normal outer cover and overlapping stretchable material flaps at the rear. This hanging action caused by the stretchable overlapped flaps provides a natural appearance to the form pad which corresponds to the natural shape of the bust. By providing this hanging type of suspension with an upper opening, the standard mastectomy form pad can be inserted into the breast cup of the brassiere in any desired orientation to compensate and correct for the individual type of surgery. This is an advantage over prior brassieres wherein the pad was held in a generally fixed position. In addition, the suspending concept for the pad retaining structure produces the most natural appearance now available in mastectomy brassieres.

The primary object of the present invention is the provision of a mastectomy brassiere of the type having breast cups each including an outer contoured cover or shield and an inner pad retaining structure, which mastectomy brassiere suspends the mastectomy form pad in a natural position which conforms to the natural appearance of a breast.

Another object of the present invention is the provision of a mastectomy brassiere, as described above, wherein the retaining structure is formed from a stretchable material which conforms to a natural breast and does not distort the outer appearance of the natural breast in the brassiere.

Still a further object of the present invention is the provision of a mastectomy brassiere, of the type described above, which brassiere is inexpensive to manufacture, allows easy insertion of the mastectomy form pad and allows easy orientation of the pad to conform with particular patients' contours.

These and other objects and advantages will become apparent from the following description taken together with the accompanying drawings.

BRIEF DESCRIPTION OF DRAWINGS

In the specification, the following drawings are included.

DESCRIPTION OF PREFERRED EMBODIMENT

Figure 1:
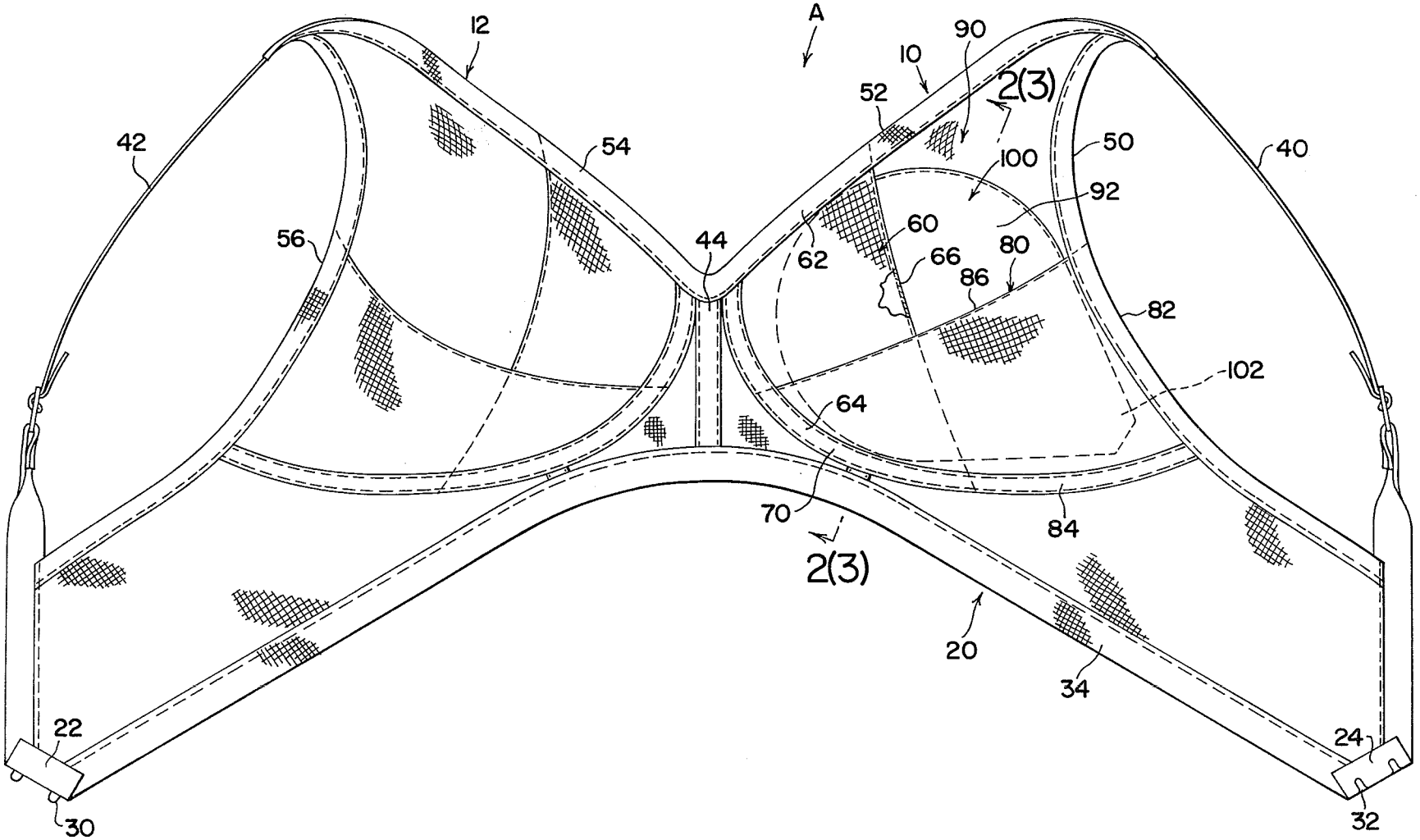
FIG. 1 is a rear view of an extended mastectomy brassiere constructed in accordance with the present invention.

Referring now to the drawings, wherein the showings are for the purpose of illustrating a preferred embodiment of the invention only, and not for the purpose of limiting same, FIG. 1 shows a mastectomy brassiere A having spaced breast cups 10, 12 both of which are identical in structure. Thus, for simplicity, only breast cup 10 will be described in detail and this description will apply equally to breast cup 12. Brassiere A includes a body encircling elastic band 20 having ends 22, 24 with appropriate clasps 30, 32, respectively. A non-elastic bottom strip 34 extends along the lower portion of brassiere A to retain the shape of encircling band 20. Appropriate straps 40, 42 extend from breast cups 10, 12, respectively, to the encircling band 20. A non-elastic center strip 44 provides vertical stability to brassiere A. Further stability to the shape of the brassiere is provided by non-elastic marginal bands 50, 52, 54 and 56. Two of these bands form the upper generally tapered portion of the spaced breast cups 10, 12.

Referring now to breast cup 10, this cup includes a first generally triangular first flap 60 formed from a stretchable material which conforms easily to any shape, such as a natural breast or mastectomy pad, and is not wrinkled to any noticeable degree during use. In addition, the stretchable material does not exert a deforming force such as an elastic material used to hold the shape and size of the brassiere. The two way stretchable nature of flap 60 is illustrated by the crossed arrows in FIG. 5. This material is well known in the brassiere art as used in various brassiere structures. The flap 60 includes edge 62 extending along peripheral non-elastic strip 52, edge 64 extending along a lower curved non-elastic strip 70 defining the lower portion of cup 10, and edge 66 extending at an angle between strips 52 and 70. A second generally triangular two way stretchable flap 80 includes edge 82 extending along non-elastic strip 50, edge 84 extending along lower elastic strip 70 and edge 86 extending at an angle between strips 50, 70. These strips are separate from each other except for the overlapping seam at lower curved strip 70. Thus, the flaps function separate from each other in their conforming and supporting functions. To complete cup 10, there is somewhat standard front cover or shield 90 formed from a non-elastic fabric having a contoured shape which conforms the natural breast or a mastectomy form pad to the desired outer appearance. Cup 10, thus, includes a pocket defined between front cover or shield 90 and the rearward flaps 60, 80. This pocket has an upper generally triangular opening 92 which is bordered by edges 66, 86. These edges extend generally upwardly from the lower strip 70 to provide a suspension in the direction indicated by arrows S in FIG. 5.

Figure 2:
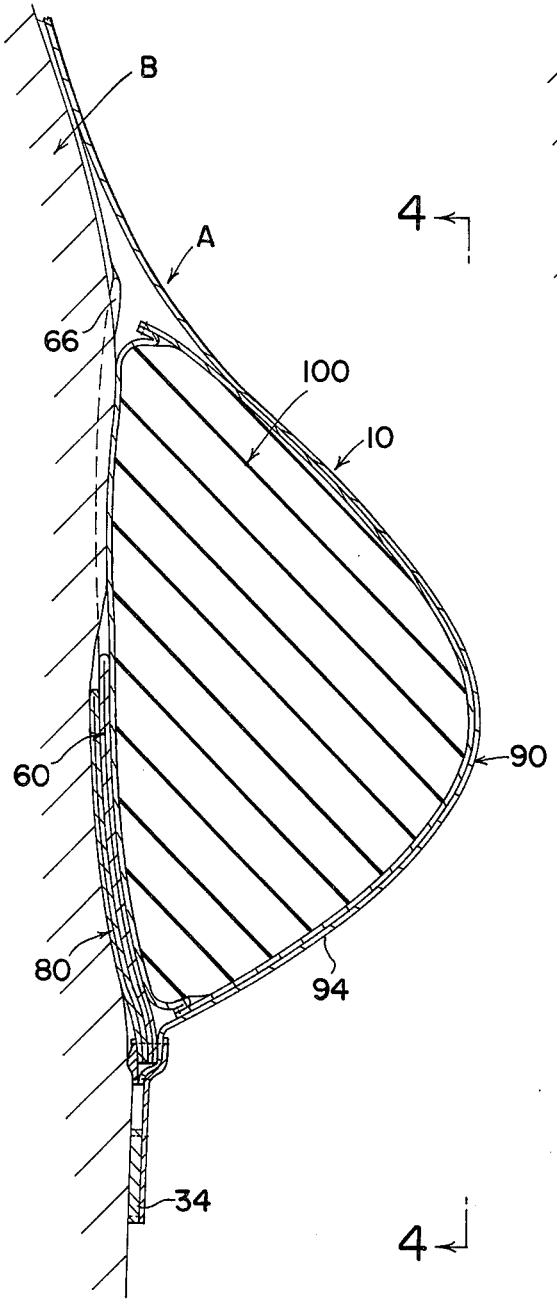
FIG. 2 is a view taken generally along line 2—2 of FIG. 1 showing a mastectomy pad in one side of the brassiere.
Figure 3:
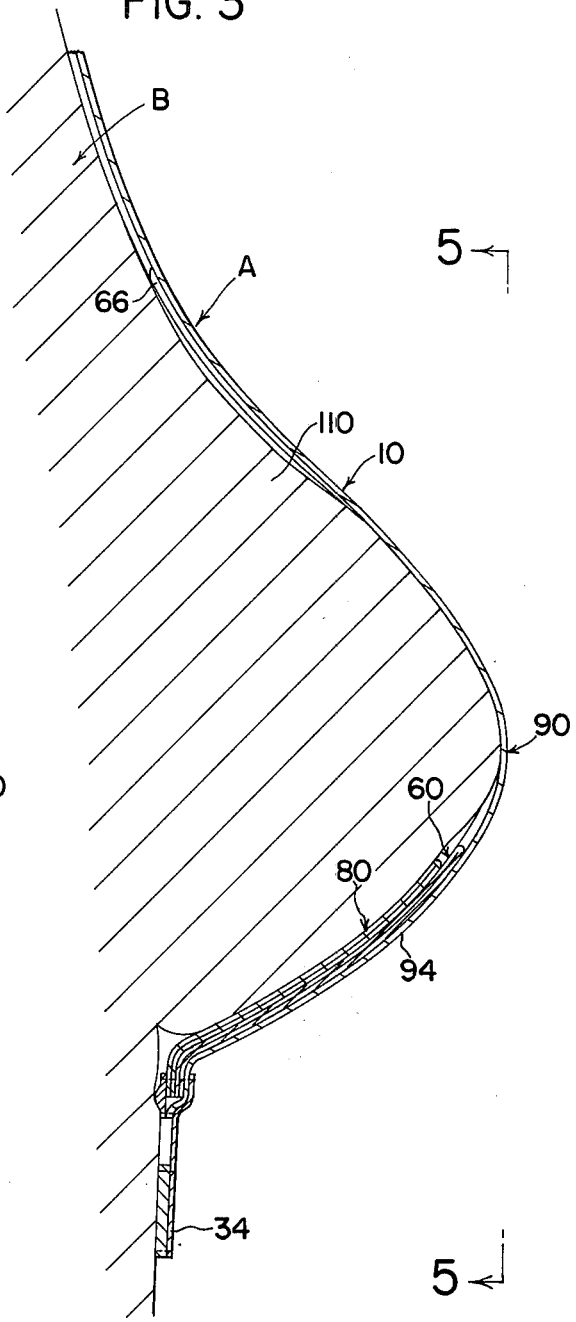
FIG. 3 is a view similar to FIG. 2 showing a natural brest occupying one side of the mastectomy brassiere.
Figure 4:
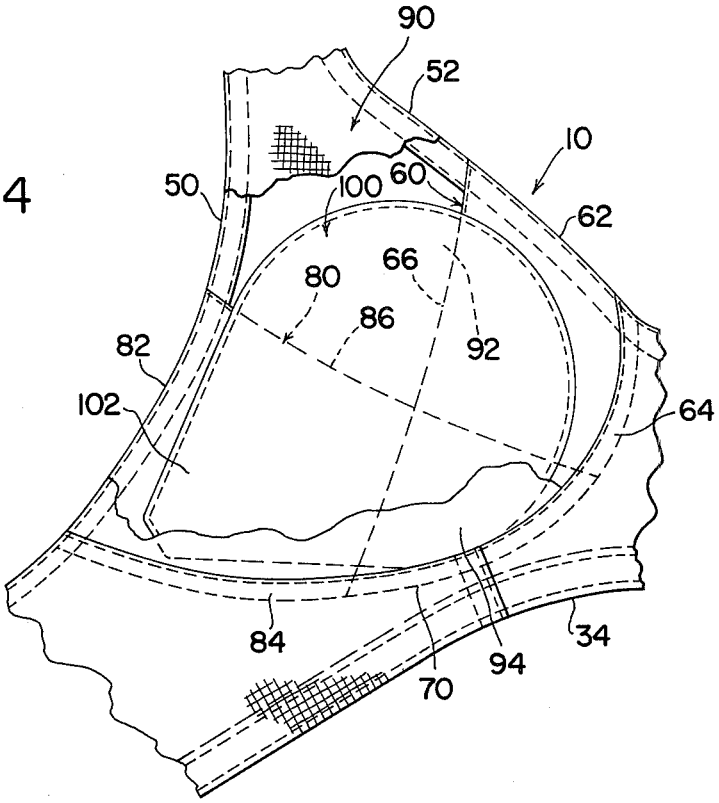
FIG. 4 is a partial view from the front portion of the preferred embodiment of the present invention illustrating the position of the mastectomy form pad; and, FIG. 5 is a view similar to FIG. 4 from the opposite side and showing certain dimensional characteristics of the preferred embodiment of the present invention.

Within the pocket of breast cup 10, a somewhat standard mastectomy form pad 100 can be inserted and oriented at the desire of the user. In normal circumstances, a neck 102 of pad 100 is oriented in the position shown in FIGS. 1 and 4. Outer cover or shield 90 has a predetermined shape which is filled by mastectomy pad 100 when brassiere A is used over a mastectomy operation of a patient B, as shown in FIG. 2. This same shape defined by the contour of cover 90 is imparted to the natural breast 110 as shown in FIG. 3. Thus, a contour imparted to outer cover or shield 90 is applied to both pad 100 and natural breast 110 so that these two structures have the same outer appearance. By providing flaps 60, 80 with a suspension structure, pad 100 is suspended and carried as a weight exerted against the lower portion 94 of cover 90. This gives the natural resilient appearance of breast 110 to the artificial breast created by mastectomy form pad 100. Force exerted by flaps 60, 80 along the arrows S of FIG. 5 assist in this suspension and natural appearance. Thus, the pockets formed by flaps 60, 80 are not solely retainers for a pad 100, but are also functional to impart a natural appearance to the mastectomy form pad.

Figure 5:
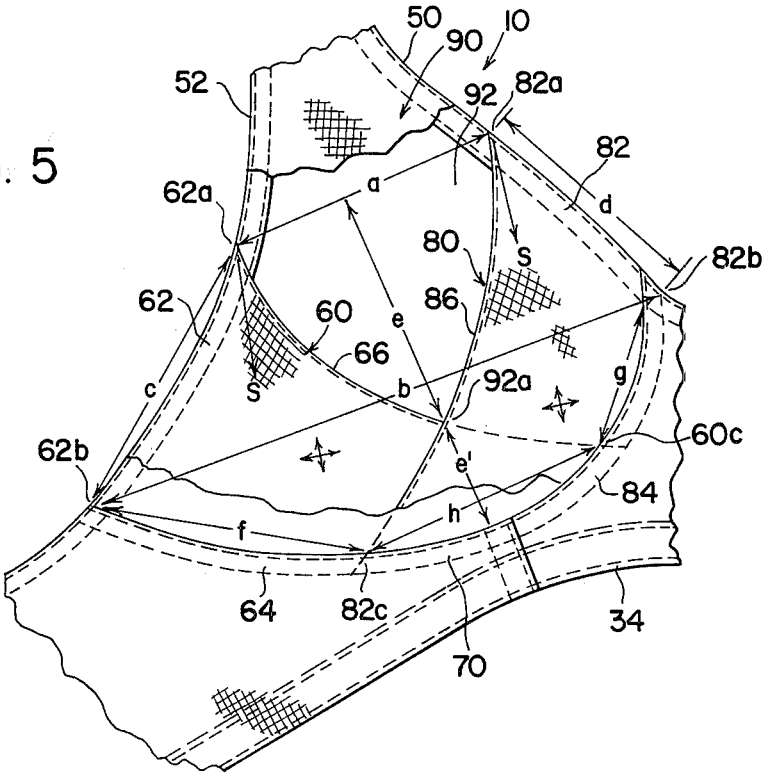

Referring now more specifically to FIG. 5, edge 62 of flap 60 extends between vertically spaced ends **62*a*, 62*b*. In a like manner, edge 82 extends between upper end 82*a* and lower end 82*b*. The third end of the generally triangular flaps 60, 80 are designated 60*c*, 82*c*, respectively. Access opening 92 is a generally triangular opening having a lower apex 92*a*. This opening has an upper spacing a between upper ends 62*a*, 82*a* of flaps 60, 80,** respectively. The transverse spacing *b* between lower ends **62*b*, 82*b*** is generally twice the distance *a*. In practice, distance *a* is approximately one-third of distance *b*. In this manner, the upper portions of flaps 60, 80 come together to form the upper supporting structure. The chordal distance *c* between **62*a*, 62*b*** is substantially greater than the chordal distance *d* between points **82*a*, 82*b*. This is caused by the more gradual taper of strip 52. The vertical height of access opening 92 is designated as e and extends from a line generally between upper ends 62*a*, 82*a* of flaps 60, 80, respectively, and lower apex 92*a*.** This distance *e* is substantially greater than the distance *e'* which extends along the same line and between apex **92*a* and lower strip 70. This again defines the upwardly extending nature of edges 66, 86 which provide a suspension for mastectomy form pad 100. To complete the details of the dimensions of FIG. 5,** chordal distance *f* extends between end **62*b* of edge 62 and end 82*c* of edge 86.** In a like manner, chordal distance *g* extends between bottom end **82*b* of edge 82 and end 60*c* of edge 66.** The distances *f* and *g* indicate that there is only an overlapping portion of flaps 60, 80 at generally the central lower portion of cup 10. This limits the amount of double fabric exposed to the front of a natural breast when cup 10 is fitted over a natural breast shown in FIG. 3. The chordal distance *f* is substantially greater than the chordal distance *g* because of the sloping nature of strip 52. Chordal distance *h* extends between points **60*c*, 82*c*** and in practice is substantially less than one-half the transverse dimension *b*. This limits the overlapping structure between flaps 60, 80.

In a preferred embodiment of the invention for a size 34B mastectomy brassiere, the dimensions of FIG. 5 are approximately as follows:

$a = 3$ inches
$b = 9$ inches
$c = 4$ inches
$d = 3.5$ inches
$e = 4.5$ inches
$e' = 2.5$ inches
$f = 4$ inches
$g = 2$ inches
$h = 3.5$ inches By these dimensions, the pocket formed with flaps 60, 80 suspends and holds pad 100 in a desirable shape within pocket 10. There is a fairly nominal amount of overlapped material. This material is formed from two way stretchable fabric and is not noticeable at the lower portion of a breast and is generally covered by portion 94 of front cover or shield 90, as shown in FIG. 3. Of course, the sizes of the fabric shown in the drawings has been enlarged for the purposes of illustration. The fabric layers do not distort the body or breast as shown in FIGS. 2 and 3. It is noted that flaps 60, 80 are doubled material to prevent an upper seam adjacent edges 66, 86 or the possibility of unraveling of the two way stretch material at this edge. This adds to the comfort and decreases the deformation against the lower portion of natural breast 110 as shown in FIG. 3.

Having thus defined the invention, it is claimed:

1. In a mastectomy brassiere including two breast cups each adapted to receive either a natural breast or a mastectomy form pad, each of said breast cups having two peripheral upwardly tapering non-elastic margin strips, a lower curved margin strip connecting said tapered margin strips, an outer non-elastic fabric cover with a desired breast forming contour and a retaining means generally spaced from fabric cover to form a pocket for a mastectomy form pad, the improvement comprising: said retaining means including first and second separate stretchable flaps, said first stretchable flap being secured along one of said marginal strips and along said lower strip, said second flap secured along the other of said marginal strips and along said lower strip, and said flaps overlapping at said lower strip to define an upper, generally triangular access opening for a mastectomy form pad.

2. The improvement as defined in claim 1 wherein said first flap has an upper end on said one marginal strip and a second end adjacent the intersection of said one marginal strip and said lower strip; said second flap has an upper end on said other marginal strip and a second end adjacent the intersection of said other marginal strip and said lower strip; and the transversing distance between said first ends of said flap being less than about one half the distance between said second end of said flaps.

3. The improvement as defined in claim 2 wherein said second end of said first flap is spaced from said second flap.

4. The improvement as defined in claim 3 wherein said second end of said second flap is spaced from said first flap.

5. The improvement as defined in claim 4 wherein said flaps have a vertical overlapped height at the apex of said triangular access opening and said access opening has a vertical height below said first ends and to said apex which is greater than said overlapped height.

6. The improvement as defined in claim 5 wherein said flaps have a transverse overlapped dimension adjacent said lower strip and this overlapped dimension is substantially less than said distance between said second ends.

7. The improvement as defined in claim 1 wherein said second end of said first flap is spaced from said second flap.

8. The improvement as defined in claim 7 wherein said second end of said second flap is spaced from said first flap.

9. The improvement as defined in claim 8 wherein said flaps have a vertical overlapped height at the apex of said triangular access opening and said access opening has a vertical height below said first ends and to said apex which is greater than said overlapped height.

10. The improvement as defined in claim 1 wherein said flaps have a vertical overlapped height at the apex of said triangular access opening and said access opening has a vertical height below said first ends and to said apex which is greater than said overlapped height.

11. The improvement as defined in claim 2 wherein said flaps have a transverse overlapped dimension adjacent said lower strip and this overlapped dimension is substantially less than said distance between said second ends.

* * * * *